US006520426B2

(12) United States Patent
Huffman

(10) Patent No.: US 6,520,426 B2
(45) Date of Patent: Feb. 18, 2003

(54) SANITARY SPRAY NOZZLE FOR SPRAY GUNS

(75) Inventor: David Clark Huffman, Merrimack, NH (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 09/764,034

(22) Filed: Jan. 17, 2001

(65) Prior Publication Data

US 2001/0032891 A1 Oct. 25, 2001

Related U.S. Application Data

(60) Provisional application No. 60/178,099, filed on Jan. 26, 2000.

(51) Int. Cl.[7] ..... B05B 1/28

(52) U.S. Cl. ..... 239/296; 239/290

(58) Field of Search ..... 239/290, 296, 239/292, 295, 297, 298, 299, 300

(56) References Cited

U.S. PATENT DOCUMENTS

| | | | | | |
|---|---|---|---|---|---|
| 2,239,987 | A | * | 4/1941 | Bramsen et al. | 239/290 |
| 2,553,401 | A | * | 5/1951 | Carr | 137/628 |
| 2,867,476 | A | * | 1/1959 | Siefen | 239/290 |
| 2,895,686 | A | * | 7/1959 | Peeps | 239/290 |
| 3,561,677 | A | * | 2/1971 | Norris et al. | 239/290 |
| 3,705,687 | A | * | 12/1972 | Vicentini et al. | 239/296 |
| 4,348,040 | A | | 9/1982 | Harjar | |
| 4,537,355 | A | | 8/1985 | Calder | |
| 4,869,936 | A | * | 9/1989 | Moskowitz et al. | 118/47 |
| 4,964,568 | A | * | 10/1990 | Rotolico et al. | 219/121.47 |
| 5,190,219 | A | * | 3/1993 | Copp | 239/296 |
| 5,292,068 | A | * | 3/1994 | Raterman et al. | 156/578 |
| 5,379,938 | A | | 1/1995 | Perret, Jr. | |
| 5,772,116 | A | * | 6/1998 | Holt | 239/124 |
| 5,944,259 | A | | 8/1999 | Brown | |
| 5,989,344 | A | * | 11/1999 | Platsch | 118/314 |
| 6,264,113 | B1 | * | 7/2001 | Dingler | 239/11 |
| 6,267,302 | B1 | * | 7/2001 | Huffman | 239/291 |
| 6,378,782 | B1 | * | 4/2002 | Craine et al. | 239/270 |
| 6,378,784 | B1 | * | 4/2002 | Allen et al. | 239/296 |

FOREIGN PATENT DOCUMENTS

GB 2 119 288 A 11/1983

OTHER PUBLICATIONS

Bradford Castmetals, Inc., catalog section "Sanitary Heavy Duty Clamps", Bradford Castmetals, Inc., Elm Grove, WI.

Bradford Castmetals, Inc., catalog section "Stainless Stell Sanitary Butt–Weld Ferrules, End Caps & Gaskets", Bradford Castmetals, Inc., Elm Grove, WI.

Bradford Castmetals, Inc., website www.bradfordmetals.com "Clamp Fittings" p., Dec. 8, 1999, Bradford Castmetals, Inc., Elm Grove, WI.

* cited by examiner

*Primary Examiner*—Lesley D. Morris
(74) *Attorney, Agent, or Firm*—Leydig, Voit & Mayer, Ltd.

(57) ABSTRACT

An automatic spray gun incorporates threadless, sanitary couplings for all air and fluid flow path connections for less contamination and lower maintenance. The spray gun nozzle body has threadless connection inlet couplings for air and fluid supply lines. There are threadless connections between the fluid tip and the nozzle body and between the air cap and the fluid tip. The nozzle body/fluid tip connection may incorporate multiple passageways for air and fluid flow; for example a center passageway for fluid flow plus annular middle and outer passageways for atomizing air and fan air respectively, for which seals such as O-rings or a full face gasket may be incorporated at this interface. The nozzle body may also have a threadless connection coupling for the actuator. The actuator can be a conventional mechanism or a diaphragm sealed shut-off/clean out needle mechanism or such other mechanism as may be available, or may simply be a block off cap in applications where air and fluid flow are controlled externally.

10 Claims, 5 Drawing Sheets

SANITARY SPRAY NOZZLE FOR SPRAY GUNS

This application relates and claims priority to U.S. applications Ser. No. 60/178,099 filed Jan. 26, 2000.

BACKGROUND OF THE INVENTION

1. Technical Field of the Invention

This invention most generally relates to automatic spray guns, both air atomizing and hydraulic pressure atomizing. In particular, it relates to automatic spray guns incorporating non-threaded couplings between all major body components and air and fluid supply lines.

2. Background Art

Conventional automatic spray guns in general have a shut off needle that seals on the back of a fluid tip or nozzle and an actuator to operate the needle with interference seals or packing to seal the liquid being sprayed. Conventional automatic spray guns also have threaded components such as a fluid tip or nozzle, threaded connections and a threaded packing retainer of some sort. Refer to prior art drawing FIG. 1, showing a conventional spray gun with a threaded air cap and threaded actuator cap, and threaded ports for inlet air and fluid line connections.

It has been standard procedure for many years in the food and pharmaceutical industries to use sanitary fittings wherever possible for valves, pipes, filters and other components, to meet both practical and regulatory sanitation requirements for avoiding contamination by or during the production process. Sanitary fittings generally consist of flanged joints having opposing flats that are abutted in a sealing fashion so as to minimize the potential for trapping trace amounts of the material in places that cannot be easily cleaned and inspected. The joints are secured for alignment and to hold against separation by pressure by mechanical means external to the seal.

In the past the use of threads has been allowed because of necessity. Automatic spray guns are complex fluid deposition nozzle mechanisms that have undergone considerable engineering scrutiny and development to optimize their performance for the many applications and fluids for which they are used. None the less, the use of internal threads has generally been considered an acceptable design solution for coupling aperatured components together for pressurized applications such as the body of the automatic spray gun. However, threaded pipe connections and couplings are inherently unsanitary. Internal threads in an automatic spray gun allow the ready accumulation and growth of bacteria, eventually contaminating the fluid flow. Threaded connections require frequent, time-consuming rotary disconnection and reconnection, and cannot be easily cleaned, polished, or inspected.

Some gun manufacturers have welded sanitary inlet connections to the body of the gun in an effort to provide sanitary connection ports for fluid and air line connections. In some cases the customer or user has undertaken to rework a standard spray gun model to gain this feature, because the sanitary inlet connection was not available from the manufacturer. This still does not address the problem of the threads that hold the fluid tip in place and also the threads that hold the seal retainer in place.

Readers may find UK Patent GB2199288 and U.S. Pat. Nos. 5,379,938, 4,348,040, 4,537,355, and 5,944,259, to provide useful context for a better appreciation of the invention, a description of which follows.

SUMMARY OF THE INVENTION

It is an object of the invention to eliminate or to isolate with seals the prior art threaded couplings common to automatic spray guns. It is a further object to improve the sanitary aspects of an automatic spray gun regarding use and maintenance, by eliminating threaded connections from the component parts. It is a yet further object to reduce the risk of contamination in the spray dispensing of fluids from automatic spray guns. It is a still yet further object of the invention to provide a face to face coupling between a nozzle body and fluid tip in a spray gun, that accommodates and seals axial and multiple annular passageways.

To these ends, in accordance with the invention, there is an automatic spray gun incorporating threadless, sanitary connection couplings for all air and fluid flow path connections. The spray gun nozzle body has threadless inlet couplings for air and fluid supply lines. The gun also has a threadless connection coupling between the fluid tip and the nozzle body and between the air cap and the fluid tip. The nozzle body/fluid tip coupling incorporates and seals, in some embodiments, multiple passageways for air and fluid flow such as a center passageway for fluid flow plus annular middle and outer passageways for atomizing air and fan air respectively.

The nozzle body also has a sanitary connection for the needle actuator on the back end of the gun. The actuator can be a conventional mechanism or a diaphragm sealed shut-off/clean out needle mechanism or such other mechanism as may be available. The actuator may be omitted and the position closed off with a threadless connection cap in applications where air and fluid flow are controlled externally. Limited departures from the all-sanitary connection couplings model can include threaded cap couplings for attaching the air cap and/or the actuator body, where the application requires accommodation of components still utilizing threaded connections.

Still other objects and advantages of the present invention will become readily apparent to those skilled in this art from the following detailed description, wherein I have shown and described only a preferred embodiment of the invention, simply by way of illustration of the best mode contemplated by me on carrying out my invention.

DESCRIPTION OF THE PREFERRED EMBODIMENT

To those skilled in the art, the invention admits of many variations. An enabling description of the preferred embodiment follows.

As a preliminary matter, a sanitary connection coupling is defined here as a non-threaded coupling system for joining pipe sections together or to hollow bodied or aperatured fittings or devices, or for joining components of such devices, such that the internal passageways are held in alignment to enable through flow of air or fluid, and where the holding or clamping structure or mechanism is external of the joint seal and is sufficiently strong to withstand ordinary internal working pressures. For example, the clamping mechanism or structure may be a commercially available channel clamp that clamps mating flanges into axial alignment and facial compression, or flange bolts applied through mating flanges, or a slotted flange, partial rotation bayonet or lug lock system, or any such non-threaded means as is known in the prior art or arises hereafter, for which the form factor is acknowledged as being by industry standards more sanitary than conventional threaded connections.

Figure 1:
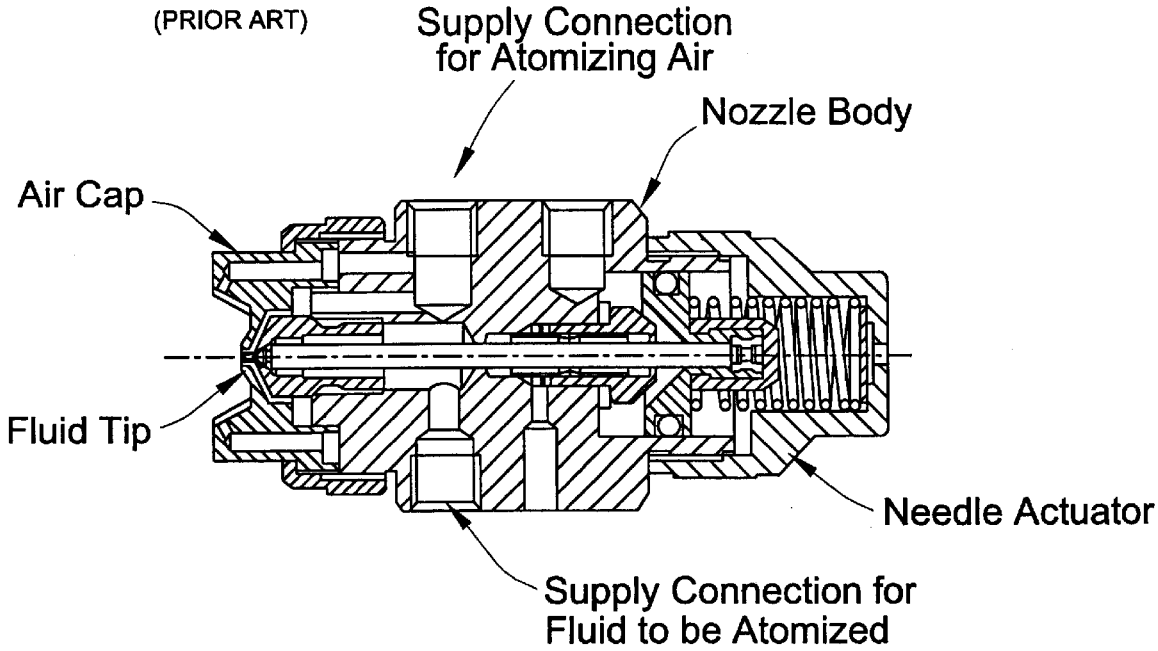
FIG. 1 (PRIOR ART)
FIG. 1 is a cross-section view of a prior art multi-fluid nozzle assembly with threaded couplings between body components and threaded inlet ports for air and fluid.

Referring back to Prior Art FIG. 1, it will be noted that the air cap/fluid tip component is coupled to the nozzle body by a threaded connection , that the actuator housing is coupled to the nozzle body by a threaded connection, and that the inlets for fluids and atomizing air are likewise configured with threaded connections.

For the following description and remaining figures, couplings will be commonly referenced as a coupling 1, and their related component parts will be identified as coupling flanges 2, ring clamps 3, and seals or sealing features 4, although their exact features may vary from one figure to another. A threaded cap coupling and all similar threaded couplings will be referred to as threaded cap coupling 5.

Figure 2:
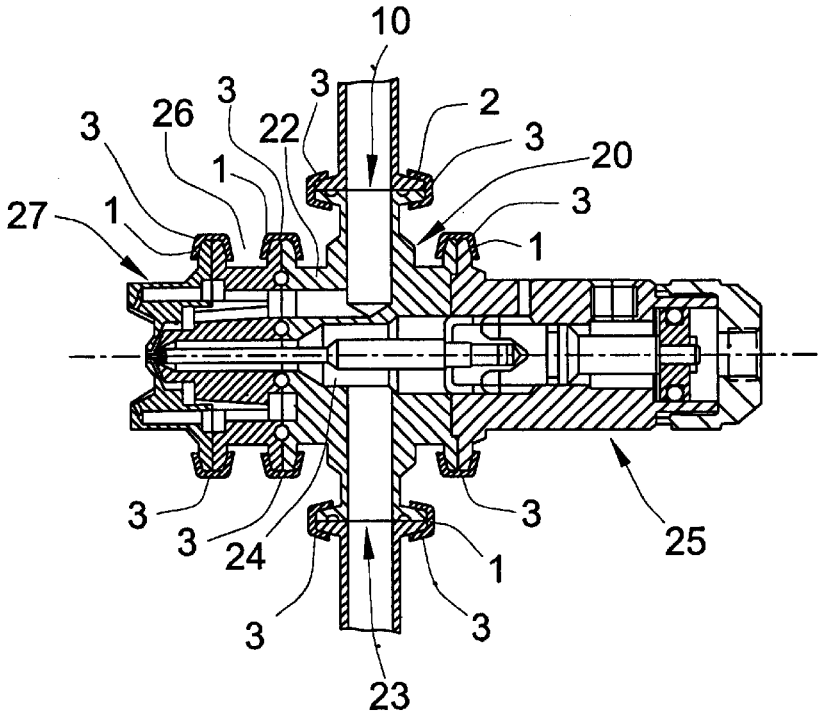
FIG. 2 is a cross-section view of a preferred embodiment of the invention, sanitary connection couplings between all body components and sanitary connection nipples for air and fluid inlets.

Referring now to FIG. 2, there is a nozzle body 20 with a topside inlet air port 21 configured with a coupling flange 2 and connecting to annular passageway 22, and a bottom side fluid inlet port 23 configured with a flange 2 and connecting to center passageway 24. Needle actuator 25 is attached by a coupling 1 consisting of a ring clamp 3 or other suitable fastening element (the ring clamps being omitted from several of the other subsequently referred to figures for clarity) which secures respective coupling flanges 2 face to face at the back end of nozzle body 20. Air cap 27 is attached to fluid tip 26 by a similar coupling 1, which is attached to the front end of nozzle body 20 by another similar coupling 1. The fluid tip 26, nozzle body 20 coupling 1 incorporates sealing features 4, in this case concentric O-rings located in respective grooves in the faces of the joined components, to seal passageways 22 and 24.

Figure 3:
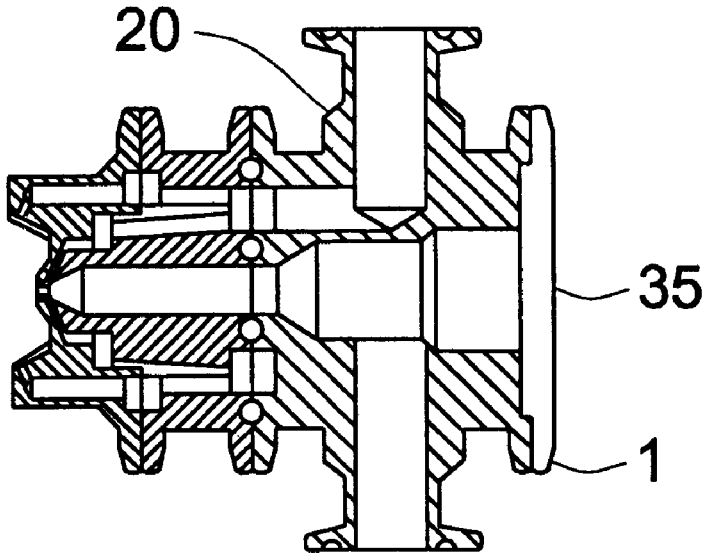
FIG. 3 is a cross-section view of a preferred embodiment of the invention, an automatic spray gun configured with a block off cap rather than an actuator, the cap being mated to the nozzle body with a sanitary connection coupling.

Referring now to FIG. 3, the needle actuator 25 is replaced by a block off cap 35, again attached to nozzle body 20 by a coupling 1, for applications where external control of air and fluid flow is provided. FIG. 3 is otherwise identical to FIG. 2.

Figure 4:
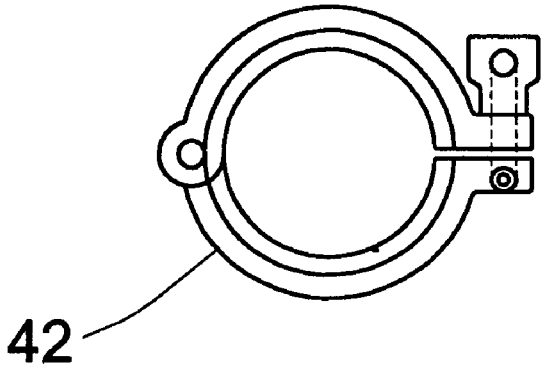
FIG. 4 is a face view of a clamp for a sanitary connection coupling, for holding the joint in axial alignment and sealed together against internal pressure.

Referring to FIG. 4, a hinged, V groove, ring clamp 42 is a preferred embodiment example of the typical clamp 3 for the common coupling 1 design appearing throughout the figures.

Figure 5:
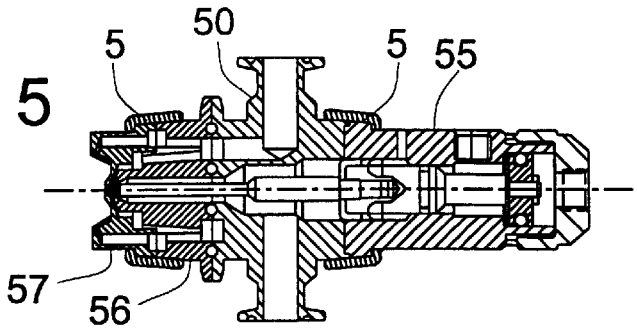
FIG. 5 is a cross section view of a limited embodiment of the invention utilizing threaded cap couplings to attach a diaphragm sealed actuator to the nozzle body and the air cap to the fluid tip.
Figure 6:
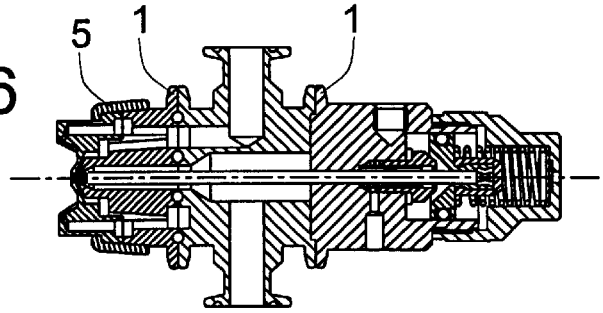
FIG. 6 is a cross section view of another limited embodiment of the invention utilizing a threaded cap coupling for the air cap to fluid tip attachment and illustrated with a conventional sealed actuator attached to the nozzle body with a sanitary connection coupling.
Figure 7:
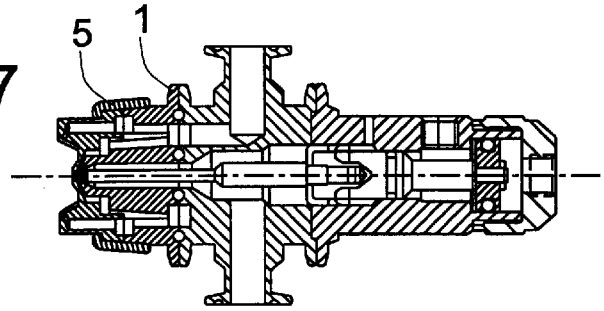
FIG. 7 is a cross section view of yet another limited embodiment of the invention utilizing a threaded cap coupling for the air cap to fluid tip attachment and illustrated with a diaphragm sealed actuator attached to the nozzle body with a sanitary connection coupling.
Figure 8:
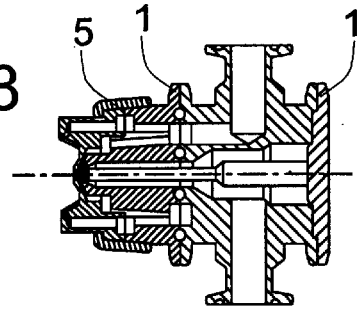
FIG. 8 is a cross section view of still yet another limited embodiment of the invention utilizing a threaded cap coupling for the air cap to fluid tip attachment and illustrated with a block off cap attached to the nozzle body with a sanitary connection coupling.
Figure 9:
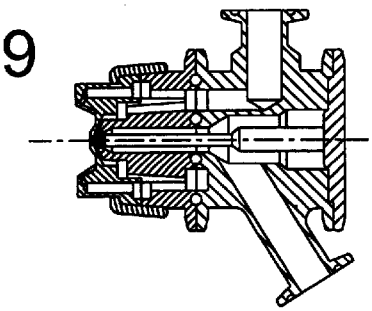
FIG. 9 is a cross section view of even still yet another limited embodiment of the invention having a back-angled fluid inlet and utilizing a threaded cap coupling for the air cap to fluid tip attachment and illustrated with a block off cap attached to the nozzle body with a sanitary connection coupling.

Referring to FIG. 5, a limited embodiment of the invention utilizes threaded cap couplings 5 to attach a diaphragm sealed actuator 55 to the nozzle body 50 and the air cap 57 to the fluid tip 56. FIGS. 6–9 show other limited embodiments with threaded aircap couplings 5; FIG. 6 having a conventional sealed actuator with clamp connection, FIG. 7 having a diaphragm sealed actuator with clamp connection, FIGS. 8 and 9 having a block off cap, and FIG. 9 illustrating an angled fluid port. These figures illustrate how the invention can accommodate various types of actuators, including diaphragm sealed and conventionally sealed actuators, as well as other variations in design, all with a goal of providing sanitary connections wherever possible within the limits of the user's other requirements.

As is commonly known to those skilled in the art, and extends to the invention, nozzle bodies may be variously configured for two or more inlets. The inlets may or may not be in a common cross plane, relative to the axis of the nozzle body, and may be variously configured as normal or at a lesser angle as to the axis of the nozzle body. For example, there may be a nozzle body with four inlet ports for air and fluid in one plane, two on opposite sides of the body and two on the topside, all configured with threadless, sanitary connection coupling flanges. As another example, a nozzle body may have two opposing air and fluid inlet ports in one cross plane, one port on top and one on the bottom, both configured with threadless, sanitary connection coupling flanges. Many other variations of inlet ports on a nozzle body are possible.

Likewise, there are many variations and combinations of prior art threaded connections and threadless connections that may be employed on an automatic spray gun that might be necessary to particular users in order to optimize interchangeable parts or utilize existing inventory of actuators or nozzles while moving towards full implementation of non-threaded, sanitary connections.

Figure 10:
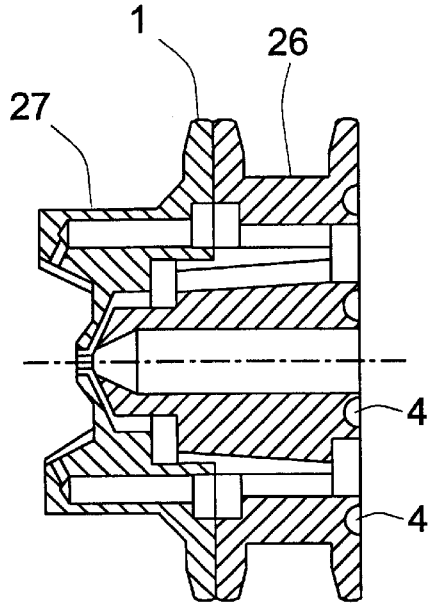
FIG. 10 is a cross section view of elements of a preferred embodiment of the invention, an air cap and fluid tip combination attached by a sanitary connection coupling, with the back side of the fluid tip configured with a sanitary connection coupling, and further illustrating the O ring seal grooves for the axial and annular fluid and air passageways.

Referring to FIG. 10, there is shown an air cap 27 and fluid tip 26 attached by a coupling 1, with the back end of fluid tip 26 having a coupling flange 2 for a coupling 1 with a nozzle body. Sealing feature 4 is a pair of concentric O-ring grooves which will accept O-rings for sealing interior fluid passageways when fluid tip 26 is mated to the matching nozzle body of FIG. 11.

Figure 11:
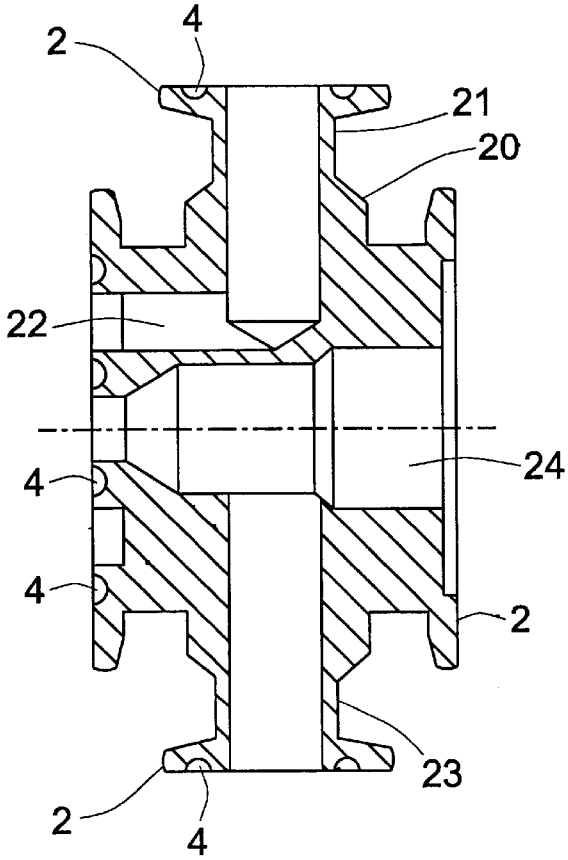
FIG. 11 is a cross section view of a nozzle body of a preferred embodiment of the invention, equipped with sanitary connection coupling flanges front and back and on the air and fluid ports, further illustrating the interior channels from inlet ports to center and annular passageways through which air and fluid flow, and O ring grooves in the coupling flats of the inlets and front face of the nozzle body.

Referring to FIG. 11, there is shown the nozzle body 20 of FIGS. 2 and 3, more clearly illustrating the topside inlet air port 21 configured with a flange 1 and connecting to annular passageway 22, and a bottom side fluid inlet port 23 configured with a flange 2 and connecting to center passageway 24. Flanges 2 and sealing features 4 are evident at the inlets and front and back ends of the nozzle body.

Figure 12B:
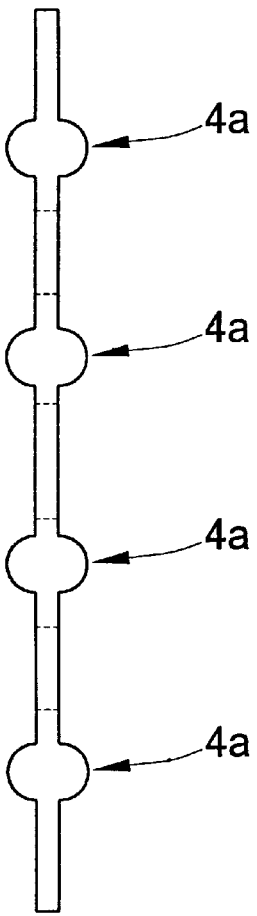
FIG. 12B is a cross section side elevation of the gasket of FIG. 12A, showing a raised bead structure of the gasket that is analogous to a pair of O-rings that might be used in the alternative.
Figure 12A:
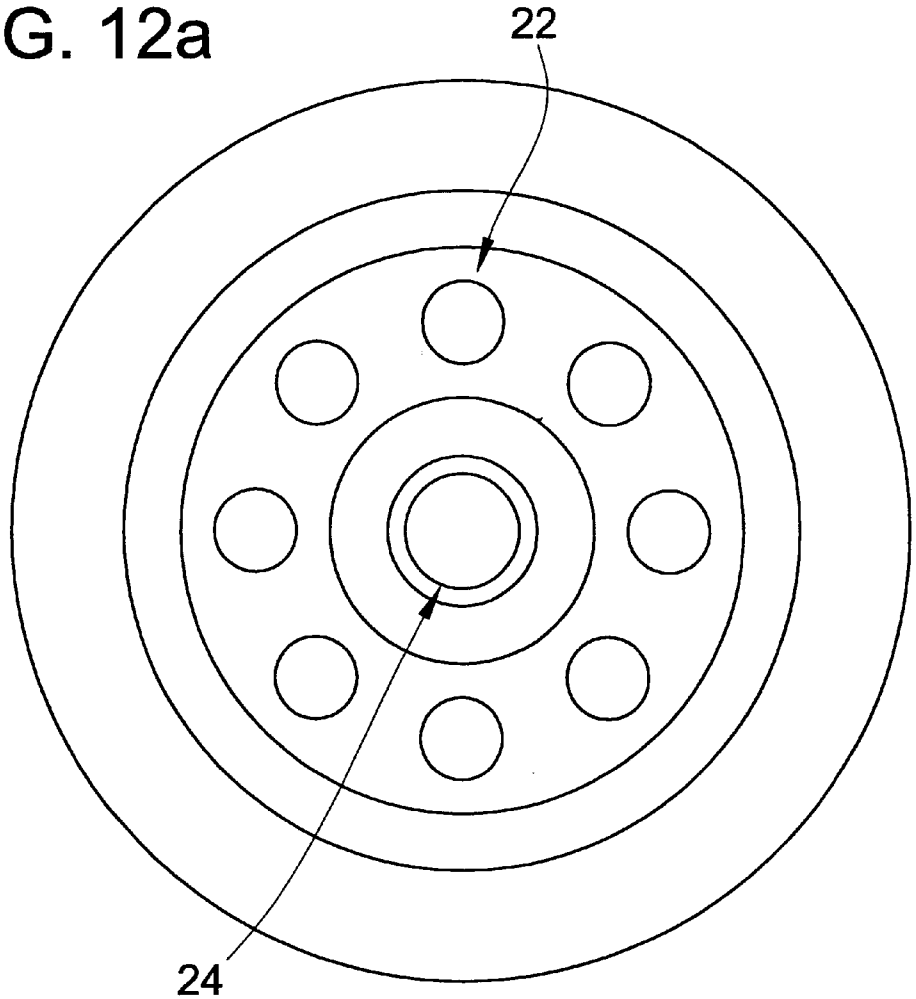
FIG. 12A is a face view of a gasket for sealing the air cap to nozzle body joint of a preferred embodiment, with a center hole for fluid flow and multiple surrounding holes for air flow.

Referring to FIGS. 12A and 12B, air passages 22 and fluid passage 24 may be sealed by a sealing feature 4 gasket, shown here in front and cross section views, configured with conforming holes for the passageways and raised ribs 4A to fit the interface grooves between fluid tip 26 of FIG. 10 and nozzle body 20 of FIG. 11.

There are other and various embodiments within the scope of the invention. For example, there is an automatic spray gun consisting of a nozzle body, an actuator, a fluid tip, and an air cap, where the nozzle body is configured with at least one air inlet and one fluid inlet, where each inlet has threadless means for connecting to a respective air or fluid supply line. The nozzle body and fluid tip are configured with a threadless means for interconnection, the fluid tip and air cap are configured with a threadless means for interconnection, and the nozzle body and actuator are configured with a threadless means for interconnection.

As a variation to the above example, there is an automatic spray gun as above, where the nozzle body and fluid tip have mating faces, and the mating faces have matching openings for central and annular passageways for fluid and air flow, where the respective openings are aligned and the passageways are sealed from leakage upon interconnection of the nozzle body to the fluid tip.

As a further variation on the above example, the passageways may be sealed by O-rings in O-ring grooves in the mating faces, or by a gasket fitting the face and grooves, with openings to accommodate the passageways. The O-ring or gasket or other sealing feature may be held in compression by the ring clamp on the coupling flanges by which the nozzle body and fluid tip are held together.

As another example, there is a nozzle body and mating fluid tip for an automatic spray gun, where the nozzle body is configured with at least one air inlet and one fluid inlet, each inlet having a threadless connector flange suitable for connection with a conforming ring clamp to a respective air or fluid supply line configured with a mating threadless connector flange, and where the nozzle body and fluid tip are each configured with mating threadless connector flanges so as to be interconnectable at the flanges with a conforming ring clamp.

As a variation on the above example, there is in addition to the nozzle body and fluid tip, an air cap, where the fluid tip and the air cap are each configured with threadless connector flanges and are interconnectable by means of a ring clamp.

As another variation on the above example, there is in addition an actuator, where the nozzle body and the actuator are configured with threadless connector flanges and are interconnectable by means of a ring clamp.

As will be realized, the invention is capable of other and different embodiments, and its several details are capable of modifications in various obvious respects, all without departing from the invention. The following claim or claims are illustrative but not exhaustive of the scope of the invention disclosed.

I claim:

1. An automatic spray gun comprising a nozzle body, an actuator, a fluid tip, and an air cap, said nozzle body configured with at least one air inlet and one fluid inlet, each said inlet having a threadless coupling for connecting to a respective air or fluid supply line, said nozzle body and said fluid tip having a threadless coupling for interconnection, said fluid tip and said air cap having a threadless coupling for interconnection, and said nozzle body and said actuator having a threadless coupling for interconnection.

2. The automatic spray gun of claim 1, said nozzle body and said fluid tip having mating faces, said mating faces comprising matching openings for central and annular passageways, respective said openings being aligned and said passageways being sealed from leakage upon said interconnection of said nozzle body to said fluid tip.

3. A nozzle body and mating fluid tip for an automatic spray gun, said nozzle body configured with at least one air inlet and one fluid inlet, each said inlet comprising a threadless connector flange suitable for connection with a conforming ring clamp to a respective air or fluid supply line configured with a mating said threadless connector flange, said nozzle body and said fluid tip each configured with said threadless connector flanges and being interconnectable there at with a said conforming ring clamp.

4. A nozzle body and mating fluid tip for an automatic spray gun according to claim 3, said nozzle body and said fluid tip having mating faces, said mating faces comprising matching openings for central and annular passageways, respective said openings being aligned and said passageways being sealed from leakage upon an interconnection of said nozzle body to said fluid tip.

5. A nozzle body and a fluid tip for an automatic spray gun according to claim 3, further comprising an air cap, said fluid tip and said air cap each configured with said threadless connector flanges and being interconnectable by means of a said ring clamp.

6. A nozzle body and a fluid tip for an automatic spray gun according to claim 3, further comprising an actuator, said nozzle body and said actuator configured with said threadless connector flanges and being interconnectable by means of a said ring clamp.

7. An automatic spray gun comprising a nozzle body, an actuator, a fluid tip, and an air cap, said nozzle body configured with at least one air inlet and one fluid inlet, each said inlet comprising a threadless connector flange suitable for connection with a conforming ring clamp to a respective air or fluid supply line configured with a mating said threadless connector flange, said nozzle body and said fluid tip each configured with said threadless connector flanges and being interconnectable there at with a said conforming ring clamp, said fluid tip and said air cap each configured with said threadless connector flanges and being interconnectable by means of a said ring clamp, and said nozzle body and said actuator configured with said threadless connector flanges and being interconnectable by means of a said ring clamp.

8. The automatic spray gun of claim 7, said nozzle body and said fluid tip having mating faces, said mating faces comprising matching openings for central and annular passageways, respective said openings being aligned and said passageways being sealed from leakage upon said interconnection of said nozzle body to said fluid tip.

9. The automatic spray gun of claim 7, said passageways being sealed by O-rings.

10. The automatic spray gun of claim 7, said passageways being sealed by a gasket.

* * * * *